US008397544B2

(12) United States Patent
Hendrickson

(10) Patent No.: US 8,397,544 B2
(45) Date of Patent: Mar. 19, 2013

(54) HOUSEHOLD CLEANING APPLIANCE WITH A SINGLE WATER FLOW PATH FOR BOTH NON-BULK AND BULK DISPENSING

(75) Inventor: Michael Stephen Hendrickson, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 890 days.

(21) Appl. No.: 12/489,548

(22) Filed: Jun. 23, 2009

(65) Prior Publication Data

US 2010/0000586 A1 Jan. 7, 2010

Related U.S. Application Data

(60) Provisional application No. 61/077,412, filed on Jul. 1, 2008.

(51) Int. Cl.
*D06F 39/02* (2006.01)

(52) U.S. Cl. ..... 68/17 R

(58) Field of Classification Search ..... 68/17 R; 222/144.5, 630; 422/261
See application file for complete search history.

(56) References Cited

U.S. PATENT DOCUMENTS

| | | | | |
|---|---|---|---|---|
| 2,872,076 | A | 2/1959 | Bloom | |
| 3,120,329 | A | 2/1964 | Noakes | |
| 4,009,598 | A | 3/1977 | Bernard et al. | |
| 4,103,520 | A | 8/1978 | Jarvis et al. | |
| 4,426,362 | A | 1/1984 | Copeland et al. | |
| 4,569,781 | A * | 2/1986 | Fernholz et al. | 510/225 |
| 5,186,912 | A | 2/1993 | Steindorf et al. | |
| 6,007,788 | A * | 12/1999 | Bellon et al. | 422/264 |
| 6,401,499 | B1 | 6/2002 | Clark et al. | |
| 6,995,129 | B2 * | 2/2006 | Olson et al. | 510/379 |
| 7,250,086 | B2 * | 7/2007 | Furber et al. | 134/18 |
| 7,275,552 | B2 * | 10/2007 | DeWeerd et al. | 134/93 |
| 2003/0116177 | A1 | 6/2003 | Appel et al. | |
| 2004/0082491 | A1 * | 4/2004 | Olson et al. | 510/375 |
| 2005/0126608 | A1 * | 6/2005 | DeWeerd et al. | 134/56 D |
| 2005/0229652 | A1 * | 10/2005 | Kim et al. | 68/237 |
| 2006/0107705 | A1 | 5/2006 | Hsu et al. | |
| 2006/0272359 | A1 * | 12/2006 | Kang | 68/17 R |
| 2007/0163307 | A1 * | 7/2007 | Kramme et al. | 68/17 R |
| 2009/0100881 | A1 * | 4/2009 | Dahlke | 68/17 R |
| 2010/0300157 | A1 * | 12/2010 | Schulze | 68/17 R |

FOREIGN PATENT DOCUMENTS

| | | | |
|---|---|---|---|
| EP | 0169604 | A2 | 1/1986 |
| EP | 0611159 | A1 | 8/1994 |
| EP | 0685587 | A1 | 12/1995 |
| GB | 2136831 | A | 9/1984 |
| WO | 2006/010924 | A1 | 2/2006 |
| WO | 2007/056097 | A2 | 5/2007 |

* cited by examiner

*Primary Examiner* — Joseph L Perrin
(74) *Attorney, Agent, or Firm* — Clifton G. Green; McGarry Bair PC

(57) ABSTRACT

An apparatus with a single water flow path suitable for a household cleaning appliance having both a non-bulk dispensing system and a bulk dispensing system.

9 Claims, 4 Drawing Sheets

HOUSEHOLD CLEANING APPLIANCE WITH A SINGLE WATER FLOW PATH FOR BOTH NON-BULK AND BULK DISPENSING

CROSS-REFERENCE TO RELATED APPLICATIONS

This application claims priority from U.S. Provisional Application No. 61/077,412 filed on Jul. 1, 2008, entitled HOUSEHOLD CLEANING APPLIANCE WITH A SINGLE WATER FLOW PATH FOR NON-BULK AND BULK DISPENSING hereby incorporated by reference.

BACKGROUND OF THE INVENTION

Contemporary household cleaning appliances, such as dishwashers or clothes washers, are a common convenience in many homes. A user simply loads the cleaning appliance with laundry to be treated into a treating chamber, along with an optional supply of a treating chemistry, such as detergents, bleach, enzymes, and anti-spotting agents and selects and initiates a cleaning cycle that may be subsequently automatically carried out by the cleaning appliance. An example of a typical cleaning cycle includes the steps of washing the laundry with heated liquid and optional treating chemistry and rinsing the laundry with heated liquid.

Cleaning appliances may be provided with a dispenser for automatically dispensing one or more treating chemistries during a cleaning cycle. There are generally two types of treating chemistry dispensing systems found in the cleaning appliances: single use dispensing systems and bulk dispensing systems. The single use dispensing system is by far the most common type and typically has one or more dispensing cups that may be filled with only enough treating chemistry, i.e. a "charge" or "dose," for a single cleaning cycle. Water is then flushed through the cup to dispense the treating chemistry. A user must fill these single use dispensing systems with treating chemistry prior to each cleaning cycle of the cleaning appliance, which may be a tedious task that many users would prefer not to perform. Users have also been known to forget to fill the cup, fill the cup with the wrong treating chemistry, or to fill the cup with the wrong amount of treating chemistry.

The bulk dispensing systems, while known, are not very common. The bulk dispensing systems hold multiple charges of treating chemistries. Some systems are capable of controlling and varying the amount of treating chemistry. These systems are more convenient to the user in the sense that the user only has to remember to fill them once over several cycles of operation. However, they are less convenient in that if the user has a non-standard wash load that requires a special treating chemistry, the bulk dispensing system may be loaded with the wrong treating chemistry.

Only a few cleaning appliances have both single use and bulk dispensing systems. The two systems are often physically separate systems, each having its own dedicated supporting structure in the appliance, which adds cost to the cleaning appliance. The different supporting structures, such as the water supply systems, must be different because the different manner in which the systems operate to dispense. This tends to lead to duplicate components, especially the water supply system for supplying water to the dispensers from the household water supply.

SUMMARY OF THE INVENTION

The invention relates to a household cleaning appliance with a single water flow path for both a non-bulk dispensing system and a bulk dispensing system.

DESCRIPTION OF EMBODIMENTS OF THE INVENTION

Figure 1:
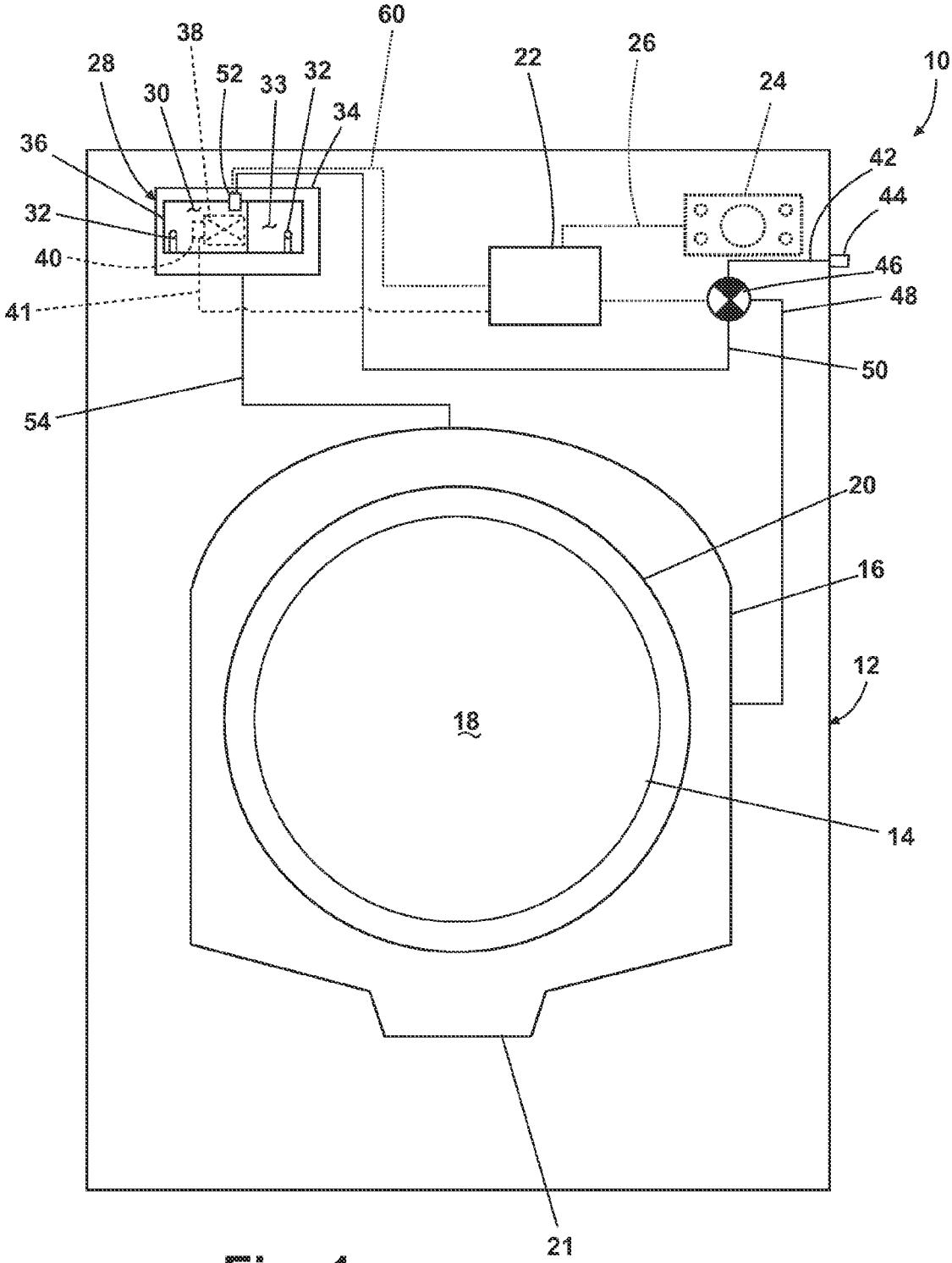
FIG. 1 is a schematic view of an automatic clothes washing machine according to the invention.

Referring now to FIG. 1, a first embodiment of the invention may be illustrated as a cleaning appliance in the environment of a horizontal axis automatic clothes washing machine 10. Although much of the remainder of this application will focus on the embodiment of an automatic clothes washing machine, the invention may have utility in other environments, including other cleaning appliances, such as dishwashers. The automatic clothes washing machine 10 shares many features of a conventional automated clothes washer, which will not be described in detail herein except as necessary for a complete understanding of the invention. The invention may also be utilized in fabric treatment appliances such as a dryer, such as a tumble dryer or a stationary dryer, or a combination washing machine and dryer.

Further, washing machines are typically categorized as either a vertical axis washing machine or a horizontal axis washing machine. As used herein, the "vertical axis" washing machine refers to a washing machine having a rotatable drum that rotates about a generally vertical axis relative to a surface that supports the washing machine. However, the rotational axis need not be vertical. The drum may rotate about an axis inclined relative to the vertical axis. As used herein, the "horizontal axis" washing machine refers to a washing machine having a rotatable drum that rotates about a generally horizontal axis relative to a surface that supports the washing machine. In some horizontal axis washing machines, the drum rotates about a horizontal axis generally parallel to a surface that supports the washing machine. However, the rotational axis need not be horizontal. The drum may rotate about an axis inclined relative to the horizontal axis, with fifteen degrees of inclination being one example of inclination.

Vertical axis and horizontal axis machines are best differentiated by the manner in which they impart mechanical energy to the fabric articles. In vertical axis machines, the fabric moving element moves within a drum to impart mechanical energy directly to the clothes or indirectly through wash liquid in the drum. In horizontal axis machines, mechanical energy is imparted to the clothes by the tumbling action formed by the repeated lifting and dropping of the clothes, which is typically implemented by the rotating drum. The invention disclosed herein may be suitable for use in both horizontal axis and vertical axis automatic clothes washing machines. The invention will be illustrated and described, however, in the context of a horizontal axis washing machine.

The automatic clothes washing machine 10 may include a cabinet 12 defining an interior and enclosing components typically found in a conventional washing machine, such as motors, pumps, fluid lines, controls, sensors, transducers, and the like. A door 14 may be mounted to the cabinet 12 to selectively close an access opening to the interior of a tub 16 that defines a treating chamber 18 in which an article may be treated. Examples of articles include, but are not limited to, a hat, a scarf, a glove, a sweater, a blouse, a shirt, a pair of shorts, a dress, a sock, a pair of pants, a shoe, an undergarment, and a jacket. One or more articles form a laundry load. Both the tub 16 and a drum 20 may be located within the interior of the cabinet 12. The tub 16 may be associated with a sump 21 for holding a liquid used during a cleaning cycle. The sump 21 may be normally connected to a drain (not shown) to provide a flow path for removing the liquids.

While the tub 16 may be described as defining the treating chamber 18, with the drum 20 located within the tub 16, and thereby located within the treating chamber 18, it may be that just the drum 20 need be considered the treating chamber 18 as the laundry load may be typically retained within the drum 20 and the treating chemistry may be directed into drum 20.

While not shown, some clothes washers include a recirculation system for recirculation of liquid from the sump to the laundry in the drum 20. The recirculating spray may be used in combination with rotating the drum to draw the sprayed liquid through the laundry using centrifugal force. Alternatively, or in combination with the recirculation system, the liquid may be raised to a level within the tub 16 where a portion of the drum 20 may be submerged. The rotation of the drum 20 causes the laundry to tumble in the liquid. Either of the recirculation or tumble methods of cleaning may be used with the current invention.

A controller 22 may receive information about a specific cleaning cycle from sensors in the automatic clothes washing machine 10 or via input by a user through a user interface 24. The user interface 24 may have operational controls such as dials, lights, switches, and displays enabling a user to input commands. To aid the input of information by the user, the user interface 24 may be electrically coupled with the controller 22 through user interface leads 26. The user may enter many different types of information, including, without limitation, cycle selection and cycle parameters, such as cycle options. Any suitable cycle may be used. Examples include, Heavy Duty, Normal, Delicates, Rinse and Spin, Sanitize, and Bio-Film Clean Out, to name a few. The term "cleaning cycle" is used to mean one operational cycle of the automatic clothes washing machine 10 that cleans a load of laundry.

A dispensing system 28 for dispensing treating chemistry during a cleaning cycle may be provided in the cabinet 12. While only the aspects of the dispensing system 28 relevant to the invention will be described, a complete description of a similar dispensing system is found in the related U.S. application Ser. No. 12/165,712, filed Jul. 1, 2008, entitled "A Household Cleaning Appliance with a Dispensing System Operable Between a Single Use Dispensing System and a Bulk Dispensing System", whose description is incorporated by reference.

The dispensing system 28 may have at least one dispensing cup 30 fluidly coupled to the treating chamber 18. FIG. 1 illustrates the at least one dispensing cup 30 as being located in the upper portion of the cabinet 12 such that a user may access it from the exterior of the cabinet 12. The at least one dispensing cup 30 may include a siphon post 32 that fluidly connects the at least one dispensing cup 30 to the treating chamber 18 such that when the at least one dispensing cup 30 overflows, the overflow goes to the treating chamber 18. FIG. 1 actually illustrates multiple dispensing cups the at least one dispensing cup 30 and another dispensing cup 33, fluidly coupled to the treating chamber 18.

The dispensing system 28 may optionally include a dispenser housing 34 fluidly coupled to the treating chamber 18 and underlying the at least one dispensing cup 30 wherein the siphon post 32 drains into the dispenser housing 34. Thus, when the at least one dispensing cup 30 overflows, the overflow goes into the dispenser housing 34 which then directs it into the treating chamber 18.

The dispensing system 28 may also optionally include a dispenser drawer 36 that contains the at least one dispensing cup 30. The dispenser drawer 36 may be slideably mounted to the cabinet 12 for movement between a closed position overlying the dispenser housing 34 and an opened position wherein the at least one dispensing cup 30 may be accessible exteriorly of the cabinet 12 and may be filled or refilled with treating chemistry.

The dispensing system 28 may also include a bulk dispensing cartridge 38 removably received in the at least one dispensing cup 30 that has an outlet fluidly coupled to the at least one dispensing cup 30 to dispense a charge of treating chemistry to the at least one dispensing cup 30. Although the bulk dispenser cartridge has been illustrated or described as a rectangular box-like container, the bulk dispensing cartridge may be any type of removable container configured to store multiple doses of a treating chemistry. The container may have any shape and size that is receivable within the dispenser. The removable container may be flexible, rigid, expandable, or collapsible. The container may be made of any type of material. Some examples of suitable cartridges are, without limitation, a plastic container, a cardboard container, a coated cardboard container, and a bladder, all of which are capable of being received within the dispenser.

When the bulk dispensing cartridge 38 is received within the at least one dispensing cup 30, the dispensing system 28 functions as a bulk dispensing system, and when the bulk dispensing cartridge 38 is not received within the at least one dispensing cup 30, the dispensing system 28 functions as a single use dispensing system.

A treating chemistry meter 40 may also be housed within the cabinet 12 and may be operably coupled to the bulk dispensing cartridge 38 to control the dosing of the treating chemistry from the bulk dispensing cartridge 38. The treating chemistry meter 40 may be integrated with the bulk dispensing cartridge 38 or separate, and it may dispense into the at least one dispensing cup 30. The treating chemistry meter 40 may be a pump fluidly coupling the bulk dispensing cartridge 38 to the at least one dispensing cup 30. The treating chemistry meter 40 may be operably coupled with the controller 22, through a control lead 41, such that the controller 22 may implement the cleaning cycle by controlling the operation of the treating chemistry meter 40 to control the dosing of the treating chemistry from the bulk dispensing cartridge 38 to the at least one dispensing cup 30.

A water supply system provides water to the dispensing system 28. The water supply system is illustrated as having a conduit 42 fluidly coupled with a water supply 44, and a valve 46. The water supply 44 may be fluidly coupled directly to the treating chamber 18 through conduit 42 to valve 46 and then through water dispensing line 48. The water supply 44 may also be coupled to the treating chamber 18 via the dispensing system 28, where water is supplied to the dispensing system 28 through the conduit 42, the valve 46, a water supply conduit 50, and a water diverter 52, which controls the flow of water to either the at least one dispensing cup 30 or the another dispensing cup 33.

The conduit 42, valve 46, water supply conduit 50, and water diverter 52 makeup a single water flow path that supplies water to the at least one dispensing cup 30 to flush treating chemistry from the at least one dispensing cup 30 to the treating chamber 18. The single water flow path may supply water and flush the treating chemistry to the treating chamber 18 both when the dispensing system 28 is being used as a bulk dispensing system and when it is being used as a single use dispensing system.

The water diverter 52 may be electrically coupled with the controller 22 through a diverter control lead 60. The controller 22 may control the operation of the water diverter 52 in response to instructions received from the user interface 24 as a result of selections made by the user, such as when manual dispensing may be desired from the another dispensing cup 33 water may be directed into the another dispensing cup 33 and when manual or bulk dispensing may be desired from the at least one dispensing cup 30 water may be directed to the at least one dispensing cup 30.

Regardless of which type of dispensing system may be used, or which dispensing cup may be used, the treating chemistry and water mix and exit the dispensing system 28 through dispensing line 54 to the treating chamber 18. The dispensing line 54 fluidly couples the dispensing system 28 with the treating chamber 18. Thus, fresh water may be delivered from the single water flow path into the dispensing system 28 for flushing treating chemistry from the dispensing system 28 through the dispensing line 54 into the treating chamber 18.

In operation, a user may elect to dispense treating chemistry to the treating chamber 18 directly from the single use dispenser, the at least one dispensing cup 30, by manually supplying a single dose of treating chemistry to the at least one dispensing cup 30 from an external supply of treating chemistry. It should be noted that a user may supply treating chemistry to the portion of the at least one dispensing cup 30 not taken up by the bulk dispensing cartridge 38 to effect manual dispensing. The user may select a manual dispense cleaning cycle on the user interface 24, which would then be implemented by the controller 22.

During the implementation of the cycle, when the time comes to dispense the treating chemistry, the controller 22 signals the valve 46 and the water diverter 52 to supply water to the at least one dispensing cup 30 from the single water flow path. Water enters into the at least one dispensing cup 30 wherein the water may be directed towards the treating chemistry located in the at least one dispensing cup 30. To dispense the treating chemistry water may be added to the at least one dispensing cup 30 until the liquid is above the siphon post 32, at which point the liquid may be drawn by gravity into the siphon post 32, which initiates a siphon process for removing the liquid from the at least one dispensing cup 30. Water may be added until it is reasonably certain that substantially all of the treating chemistry is dispensed from the at least one dispensing cup 30. This is referred to as "flushing" the at least one dispensing cup 30. The water and the treating chemistry then overflow into the dispenser housing 34 through the siphon post 32.

Essentially, the automatic clothes washing machine 10 effects a flushing of the at least one dispensing cup 30, the dispenser housing 34, and the conduit formed by the dispenser housing 34 and the dispensing line 54. As such, both the water and the treating chemistry travel from the at least one dispensing cup 30 and into the treating chamber 18. After exiting the dispenser housing 34 the treating chemistry may also go through any accompanying sprayers or conduits on its way to the treating chamber 18.

Alternatively, the user may insert or may have already inserted the bulk dispensing cartridge 38 into the at least one dispensing cup 30 and elect to dispense treating chemistry to the treating chamber 18 from the bulk dispensing cartridge 38. A selected volume of treating chemistry may be dispensed from the bulk dispensing cartridge 38 through operation of the treating chemistry meter 40 under the control of the controller 22. Typically, this could be accomplished by the user selecting a cleaning cycle on the user interface 24, which would then be processed by the controller 22, along with a determination in a known manner of the size of the load, to automatically dispense the appropriate volume of treating chemistry.

As with the single use dispensing, during the implementation of the cleaning cycle, when the time comes to dispense the treating chemistry, the controller 22 signals the treating chemistry meter 40 to supply treating chemistry from the bulk dispensing cartridge 38 to the portion of the at least one dispensing cup 30 not taken up by the bulk dispensing cartridge 38. The controller 22 then signals the valve 46 and the water diverter 52 to supply water to the at least one dispensing cup 30 from the single water flow path. Water enters into the at least one dispensing cup 30 wherein the water may be directed towards the treating chemistry, dispensed by the bulk dispensing cartridge 38, and located in the at least one dispensing cup 30. Less water may be needed to effect the flushing because the bulk dispensing cartridge takes up a portion of the at least one dispensing cup 30. The flushing of the at least one dispensing cup 30 may also act to flush the treating chemistry meter 40, which fluidly couples the at least one dispensing cup 30. Then, both the water and the treating chemistry travel through the dispenser housing 34 and through the dispensing line 54, and into the treating chamber 18.

The treating chemistry meter 40 may dose treating chemistry into the treating chamber 18 multiple times during a single cleaning cycle. Dosing of the treating chemistry does not need to be done all at one time. For example, smaller amounts of treating chemistry, which collectively equal a single dose, may be dispensed by the treating chemistry meter 40 at separate times throughout the cleaning cycle. Further, multiple full doses may be dispensed during the cleaning cycle. As used herein, the term "single dose of treating chemistry" and variations thereof, refers to an amount of treating chemistry sufficient for one cleaning cycle of the automatic clothes washing machine 10 and the term "multiple doses of treating chemistry" and variations thereof, refers to an amount of treating chemistry sufficient for multiple cleaning cycles of the automatic clothes washing machine.

The single water flow path provides for a simplified water system that reduces the redundancy in the water supply system. It also provides a simple mechanism by which the controller 22 may effect the dispensing from either the single use dispensing system or the bulk dispensing system. The controller 22 need only select how much water to dispense to effect dispensing.

Figure 2:
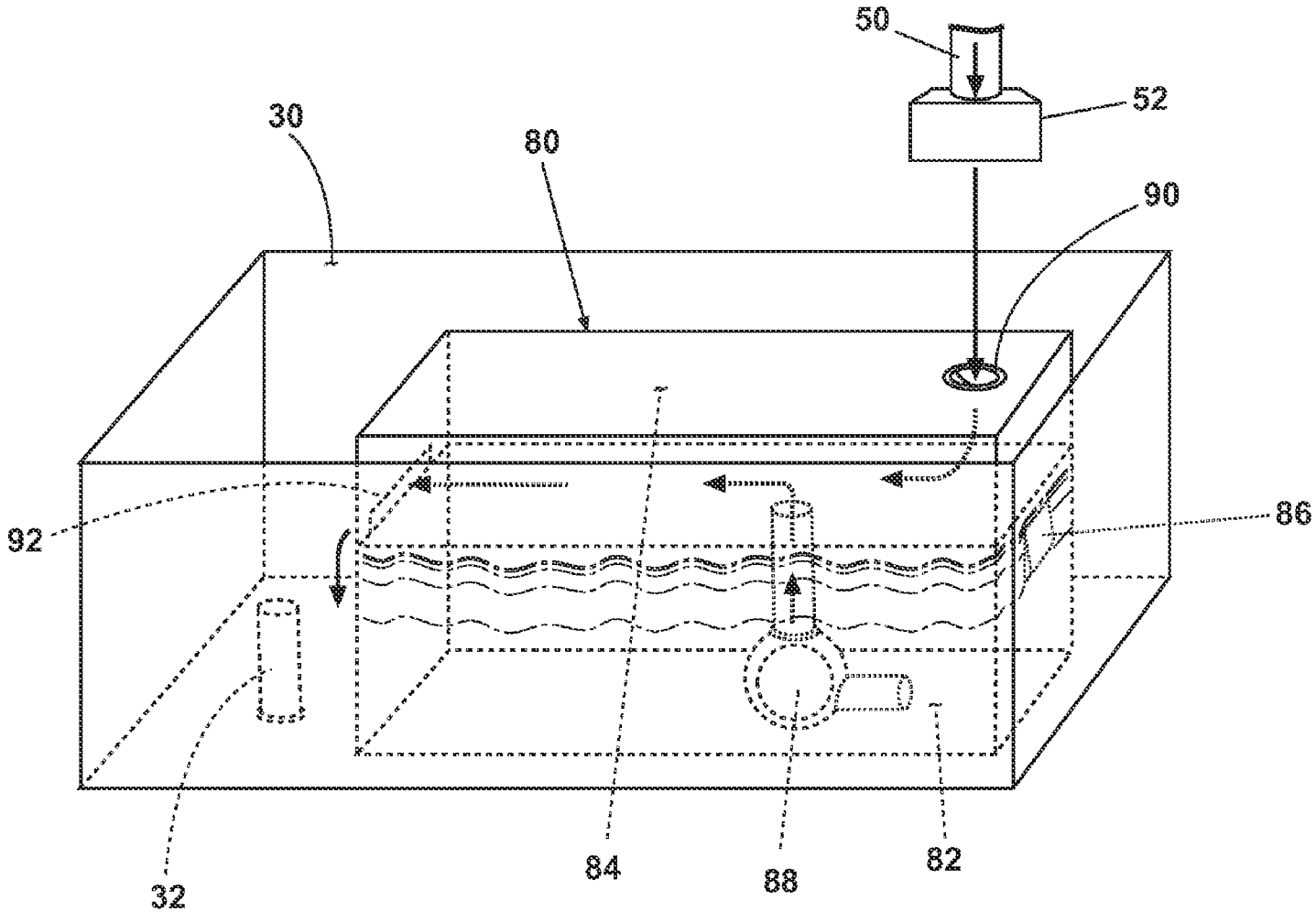
FIG. 2 is a schematic view of an alternative exemplary bulk dispensing cartridge that may be used in the automatic clothes washing machine illustrated in FIG. 1.

FIG. 2 schematically illustrates an alternative exemplary bulk dispensing cartridge 80 that may be used in the dispensing system 28. The bulk dispensing cartridge 80 may be illustrated as a generally rectangular box-like container defining a cartridge cavity 82 in which the treating chemistry may be contained. A through passage 84 is located above the lower cavity 82. The cartridge cavity 82 may be accessible through an opening selectively closed by a closing element 86 operable between an opened and closed position through which the bulk dispensing cartridge 80 may be filled when the closing element 86 is in the opened position. The cartridge cavity 82 may be fluidly coupled to the through passage 84 to effect the flow a treating chemistry from the lower cartridge cavity 82 into the through passage 84. A treating chemistry meter 88 may be used to fluidly couple the cartridge cavity 82 to the through passage 84 to control the dosing of the treating chemistry from the cartridge cavity 82 to the through passage 84. The treating chemistry meter 88 may have a fluid inlet fluidly connected to the cartridge cavity 82 and a fluid outlet fluidly connected to the through passage 84.

The bulk dispensing cartridge 80 may also have a bulk dispensing cartridge fluid inlet 90 and a bulk dispensing cartridge outlet 92 which are both fluidly connected to the through passage 84. In this way, water may be flushed through the through passage 84 to flush out any treating chemistry that is dispensed into the through passage 84 from the cartridge cavity 82 by the meter 88. More specifically, the water supply conduit 50 and water diverter 52 may supply water to the bulk dispensing cartridge fluid inlet 90. This forms a single water flow path that supplies water to the at least one dispensing cup 30 by way of the through passage 84.

In operation, a selected volume of treating chemistry may be dispensed from the bulk dispensing cartridge 80 through operation of the treating chemistry meter 88 under the direction of the controller 22. The treating chemistry may be dosed from the cartridge cavity 82 to the through passage 84 by the treating chemistry meter 88 under control of the controller 22. The controller 22 then signals the valve 46 and the water diverter 52 to supply water to the bulk dispensing cartridge fluid inlet 90 from the single water flow path. Water enters into the bulk dispensing cartridge fluid inlet 90 wherein the water may be directed towards the treating chemistry in the through passage 84 where the water and treating chemistry may form a mixture. The mixture travels by way of the through passage 84 out the bulk dispensing cartridge fluid outlet 92 where it may then flow into the at least one dispensing cup 30. Then the mixture may flow through the siphon post 32 to the dispenser housing 34, through the dispensing line 54, and into the treating chamber 18. Thus, the bulk dispensing cartridge 80 has a through passage 84 through which the supplied water flows to flush the treating chemistry to the treating chamber 18. It should be noted that the treating chemistry meter 88 may have a mechanism to stop backflow into the cartridge cavity 82 such that the flushing of the through passage 84 does not act to flush the treating chemistry meter 88.

Alternatively, a user may elect to dispense treating chemistry to the treating chamber 18 directly from a dispensing cup 30 without the bulk dispensing cartridge, the single use dispenser. The user may select a manual dispense cleaning cycle on the user interface 24, which would then be processed by the controller 22. When the time comes to dispense the treating chemistry, the controller 22 signals the valve 46 and the water diverter 52 to supply water to the bulk dispensing cartridge fluid inlet 90 from the single water flow path. Water enters into the bulk dispensing cartridge fluid inlet 90 and flows by way of the through passage 84 before traveling out the bulk dispensing cartridge fluid outlet 92 where it may then flow into the at least one dispensing cup 30 and towards the treating chemistry located therein. Then, both the water and the treating chemistry travel through the siphon post 32 to the dispenser housing 34 through the dispensing line 54 and into the treating chamber 18. With this configuration, a single water flow path supplies water to either the single user dispenser or the bulk dispenser. This structure eliminates the need and cost for separate water flow paths.

The determination of whether the single use dispensing system is used or the bulk dispensing system is used is described as being based on the cycle selected by the user, the determination may be made in many ways and is not germane to the invention. The determination may be made by the controller 22 having one or more suitable sensors for detecting the type and quantity of treating chemistry in the multiple dispensing cups 102, 104, 106 and applying control logic to this information to select which dispensing system to use. The controller 22 may also dispense from both dispensing systems during a single cycle. For example, it is contemplated that the bulk dispensing cartridge will hold detergent, as it is the most common treating chemistry, and the other multiple dispensing cups 104, 106 will hold bleach and/or fabric softener, which are often optional for many of the cycles. In such a situation, the controller 22 would dispense detergent from the bulk dispensing cartridge at the appropriate time in the cycle and, if there is treating chemistry in one or more of the multiple dispensing cups 102, 104, 106, the controller 22 would dispense that treating chemistry at the appropriate time in the cycle.

Figure 3:
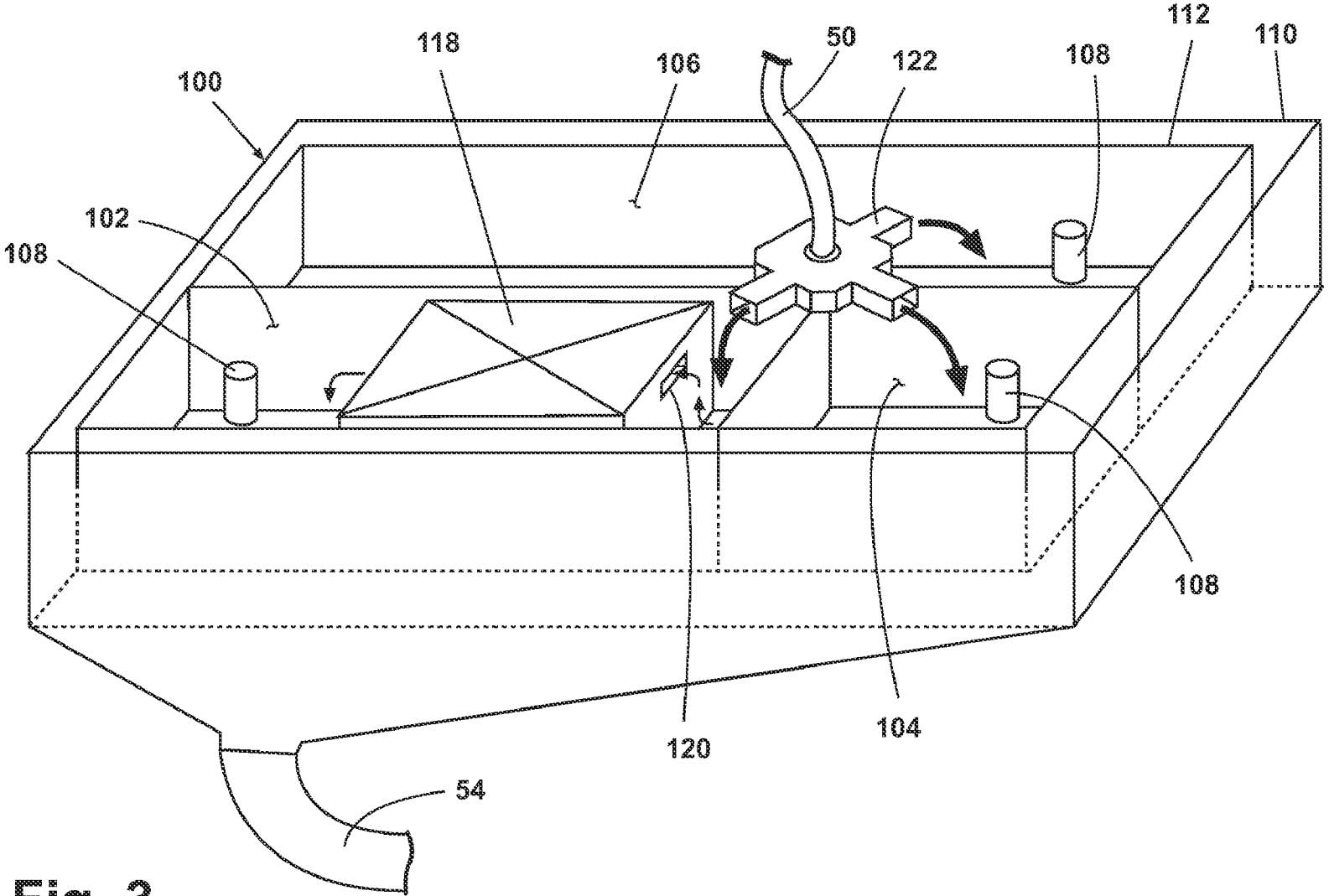
FIG. 3 is a schematic view of an exemplary dispensing system that may be used in the automatic clothes washing machine illustrated in FIG. 1.

FIG. 3 illustrates a specific implementation of a dispensing system 100 that may be used to form part of the dispensing system 28 in the cabinet 12. The dispensing system 100 may have multiple dispensing cups 102, 104, 106 fluidly coupled to the treating chamber 18 through the dispensing line 54. At least one of the multiple dispensing cups 102, 104, 106 may define a single use dispenser that stores a single dose of treating chemistry that the dispensing system 100 dispenses to the treating chamber 18, as part of the execution of the cleaning cycle. The multiple dispensing cups 102, 104, 106 may include siphon posts 108 that fluidly connect the multiple dispensing cups 102, 104, 106 to the treating chamber 18 such that when one of the multiple dispensing cups 102, 104, 106 overflows, the overflow is siphoned to the treating chamber 18.

The dispensing system 100 may optionally include a dispenser housing 110 fluidly coupled to the treating chamber 18 and underlying the multiple dispensing cups 102, 104, 106 wherein the siphon posts 108 drain into the dispenser housing 110. Thus, when the multiple dispensing cups 102, 104, 106 overflow, the overflow is siphoned into the dispenser housing 110 that then directs it into the treating chamber 18.

The dispensing system 100 may also optionally include a dispenser drawer 112 that contains the multiple dispensing cups 102, 104, 106. The dispenser drawer 112 may be slideably mounted to the cabinet 12 for movement between a closed position overlying the dispenser housing 34 and an opened position exterior of the dispenser housing 34. When the dispenser drawer 112 may be in an opened position, the multiple dispensing cups 102, 104, 106 are accessible exteriorly of the cabinet 12 and may be filled or refilled with treating chemistry.

The dispensing system 100 may also include a bulk dispensing cartridge 118 as previously described that is able to be removably received in one of the multiple dispensing cups 102, 104, 106. The bulk dispensing cartridge 118 is illustrated as having a through passage 120. The through passage 120 is like that described above except that the inlet to the through passage 120 is located on the side of the bulk dispensing cartridge 118 instead of the top and the through passage 120 is sloped downwards from its inlet to its outlet. The through passage 120 may fluidly couple a water diverter 122 to the dispensing cup 102.

When the dispenser drawer 112 is in the closed position, the water diverter 122 is position to direct water from the supply line 50 to each of the multiple dispensing cups 102, 104, 106. The water supply conduit 50 may be fluidly coupled with the water diverter 122 such that a single water flow path supplies water to any one of the multiple dispensing cups 102, 104, 106 to flush treating chemistry from the multiple dispensing cups 102, 104, 106 to the treating chamber 18. A single water flow path supplies water to the dispensing system 100, through the water diverter 122, to flush treating chemistry from either of the single use dispenser or the bulk dispenser to the treating chamber 18. The water diverter 122 may be electrically coupled with the controller 22 through a valve control lead (not shown). The controller 22 may control the operation of the water diverter 122 in response to instructions received from the user interface 24 as a result of selections made by the user, such as when manual dispensing may be desired or when bulk dispensing may be desired Thus, the water diverter 122 supplies water to the multiple dispensing cups 102, 104, 106 and the water diverter 122 fluidly couples the single water flow path to any one of the multiple dispensing cups 102, 104, 106. The single water flow path may supply water and flush the treating chemistry to the treating chamber 18 both when the dispensing system 28 is operating as a bulk dispensing system and when it is operating as a single use dispensing system.

In operation, when the bulk dispensing cartridge 118 is properly installed in one of the multiple dispensing cups 102, a user may elect to dispense treating chemistry to the treating chamber 18, from the bulk dispensing cartridge 118. If a bulk dispensing cycle is selected, water is directed into the dispensing cup 102, when the water reaches a level above the opening of the through passage 120 it then flows down the sloped through passage 120 and out of the bulk dispensing cartridge 118 towards the siphon post 108. In this way, water may be flushed through the through passage 120 to flush out any treating chemistry that is dispensed into the through passage 120 from a reservoir or cavity within the bulk dispensing cartridge 118. Typically, this could be accomplished by a user selecting a cleaning cycle on the user interface 24, which would then be processed by the controller 22, along with a determination in a known manner of the size of the load, to automatically dispense the appropriate volume of treating chemistry. Alternatively, the user selecting a volume of treating chemistry on the user interface 24 would accomplish this. Then the controller 22 may control the operation of the water diverter 122 to provide water to one of the multiple dispensing cups 102, 104, 106.

Alternatively, a user may pour a single dose of treating chemistry into any of the multiple dispensing cups 102, 104, 106 including into the portion of the multiple dispensing cup 102 where the bulk dispensing cartridge 118 is not housed. Then the controller 22 may control the operation of the water diverter 122 to provide water to any of the multiple dispensing cups 102, 104, 106 where the user poured the treating chemistry.

The water diverter 122 provides for a simplified water system that reduces the redundancy in the water supply system. It also provides a simple mechanism by which the controller 22 may effect the dispensing from either the single use dispensing system or the bulk dispensing system. To effect dispensing the controller 22 need only select which multiple dispensing cup 102, 104, 106 to flush.

Figure 4:
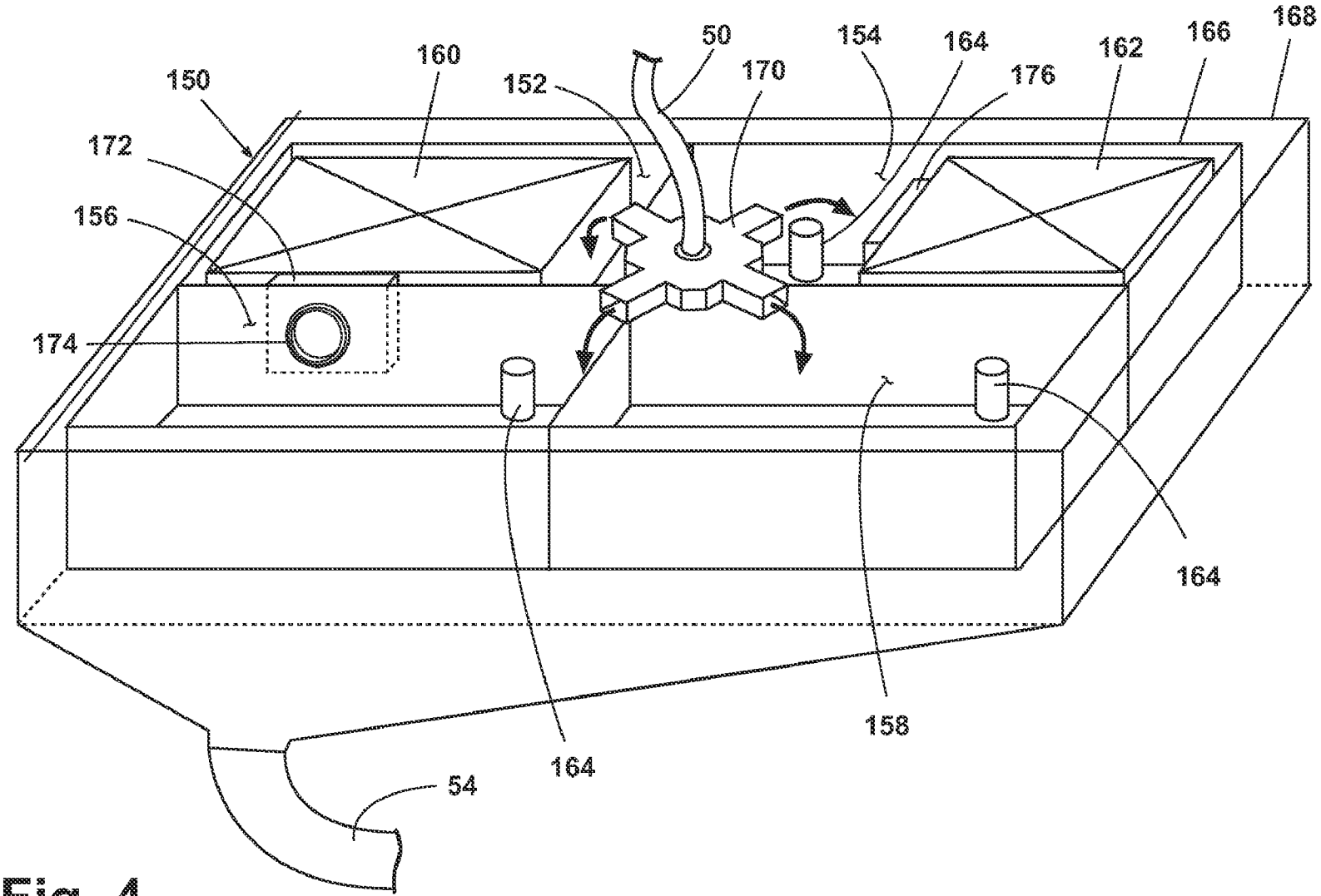
FIG. 4 is a schematic view of a second exemplary dispensing system that may be used in the automatic clothes washing machine illustrated in FIG. 1.

FIG. 4 illustrates a second specific implementation of a dispensing system 150 that may be installed in place of the dispensing system 28 in the cabinet 12. The dispensing system 150 is similar to the dispensing system 100 except that it has four multiple dispensing cups 152, 154, 156 158 and two bulk dispensing cartridges 160, 162 have been illustrated in two of the multiple dispensing cups 152, 154 respectively. Further, the dispensing system 150 includes siphons 164, a dispenser drawer 166, a dispenser housing 168 fluidly connected to the treating chamber 18 through dispensing line 54, and a water diverter 170. It should be noted that any configuration of dispensing cups and bulk dispensing cartridges may be used in place of the dispensing system 28 in cabinet 12.

It should also be noted that if other configurations are used, such as the dispensing system 150, a water diverter 170 should be relocated such that it overlies the all of the multiple dispensing cups 152, 154, 156, 158 and may flush treating chemistry from any of the multiple dispensing cups 152, 154, 156, 158 into the treating chamber 18. Multiple water diverters may be put into the single water flow path to enable even larger configurations of multiple dispensing cups to be supplied by a single flow of water.

A first treating chemistry meter 172 may fluidly couple the bulk dispensing cartridge 160 with another of the multiple dispensing cups 156 through a port 174. That is, the first treating chemistry meter 172 may be operate to dispenses treating chemistry from the bulk dispensing cartridge 160 to a dispensing cup in which the bulk dispensing cartridge 160 is not located. A second treating chemistry meter 176 may fluidly couple the bulk dispensing cartridge 162 to the multiple dispensing cup 154 in which the bulk dispensing cartridge 162 is received. Thus, a treating chemistry meter may be used to dispense treating chemistry to either a dispensing cup in which the bulk dispensing cartridge is received or a dispensing cup in which the bulk dispensing cartridge is not received.

The water diverter 170 provides for a simplified water system that reduces the redundancy in the water supply system. It also provides a simple mechanism by which the controller 22 may effect the dispensing from either the single use dispensing system or the bulk dispensing system. The controller 22 need only select which multiple dispensing cups to flush to effect dispensing.

While the invention has been specifically described in connection with certain specific embodiments thereof, it is to be understood that this is by way of illustration and not of limitation, and the scope of the appended claims should be construed as broadly as the prior art will permit.

What is claimed is:

1. A household cleaning appliance configured to execute a cleaning cycle on an article, comprising:

a cabinet defining an interior;

a treating chamber located within the interior for receiving the article for cleaning;

a dispensing system having multiple dispensing cups fluidly coupled to the treating chamber, with a first of the multiple dispensing cups defining a single use dispenser;

a bulk dispensing cartridge received in another one of the multiple dispensing cups to define a bulk dispenser, the bulk dispensing cartridge having an outlet fluidly coupled to the first of the multiple dispensing cups through a port defined between the another one of the multiple dispensing cups and the first of the multiple dispensing cups; and a single water flow path supplying water to the dispensing system to flush treating chemistry from either of the single use dispenser or the bulk dispenser to the treating chamber.

2. The household cleaning appliance according to claim 1, wherein the dispensing system further comprises a water diverter fluidly coupling the single water flow path to any one of the multiple dispensing cups.

3. The household cleaning appliance according to claim 1, wherein the outlet is fluidly coupled to any one of the multiple dispensing cups to dispense the treating chemistry thereto.

4. The household cleaning appliance according to claim 1, wherein the outlet is fluidly coupled to the another one of the multiple dispensing cups in which the bulk dispensing cartridge is received.

5. The household cleaning appliance according to claim 1, wherein the bulk dispensing cartridge comprises a through passage through which the supplied water flows to flush the treating chemistry to the treating chamber.

6. The household cleaning appliance according to claim 5, wherein the outlet of the bulk dispensing cartridge is fluidly coupled to the through passage.

7. The household cleaning appliance according to claim 1, wherein the dispensing system further comprises a housing fluidly coupled to the treating chamber and underlying the multiple dispensing cups to direct the flushed treating chemistry into the treating chamber.

8. The household cleaning appliance according to claim 7, wherein the dispensing system further comprises a water diverter overlying the multiple dispensing cups and fluidly coupling the single water flow path to any one of the multiple dispensing cups.

9. The household cleaning appliance according to claim 8, wherein the dispensing system further comprises a drawer containing the multiple dispensing cups and slideably mounted to the cabinet for movement between a closed position overlying the housing and an opened position exterior of the housing.

* * * * *